US006247422B1

(12) United States Patent
Murray, III

(10) Patent No.: US 6,247,422 B1
(45) **Date of Patent: *Jun. 19, 2001**

(54) PLANING WATERCRAFT HULL AND PROPULSION SYSTEM

(75) Inventor: John Patrick Murray, III, New York, NY (US)

(73) Assignee: J. P. Murray Co., Inc., Beacon, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/148,677

(22) Filed: Sep. 4, 1998

(51) Int. Cl.[7] ..... B63B 1/00
(52) U.S. Cl. ..... 114/271
(58) Field of Search ..... 114/271, 352, 114/77 A, 77 R, 40, 41, 56.1, 61.27, 61.29, 61.3, 61.31, 61.32, 61.33; D12/300

(56) References Cited

U.S. PATENT DOCUMENTS

| | | | | |
|---|---|---|---|---|
| 1,822,199 | * | 9/1931 | Carns | 114/291 |
| 2,729,183 | * | 1/1956 | Owen | 114/271 |
| 4,664,054 | | 5/1987 | Nishida | 114/270 |
| 4,760,814 | | 8/1988 | Kobayashi | 114/270 |
| 4,811,682 | | 3/1989 | Hwang et al. | 114/345 |
| 4,813,365 | * | 3/1989 | Lindstrom et al. | 114/271 |
| 4,942,838 | | 7/1990 | Boyer et al. | 114/345 |
| 4,964,821 | | 10/1990 | Tafoya | 440/38 |
| 5,170,735 | | 12/1992 | Kobayashi | 114/56 |
| 5,209,683 | | 5/1993 | Imaeda et al. | 440/38 |
| 5,309,856 | | 5/1994 | Kobayashi | 114/56 |
| 5,660,131 | * | 8/1997 | Gulling et al. | 114/40 |

FOREIGN PATENT DOCUMENTS

| | | | | |
|---|---|---|---|---|
| 2999 | * | of 1906 | (GB) | 114/271 |

* cited by examiner

*Primary Examiner*—Ed Swinehart
(74) *Attorney, Agent, or Firm*—Mathews, Collins, Shepherd & Gould, P.A.

(57) ABSTRACT

An improved planing watercraft hull having reduced surface area in contact with the water resulting in a minimization of drag said hull capable of being adapted for use with a small, easily transportable waterjet propelled watercraft.

45 Claims, 6 Drawing Sheets

PLANING WATERCRAFT HULL AND PROPULSION SYSTEM

BACKGROUND AND SUMMARY OF THE INVENTION

The present invention relates in general to an improved planing watercraft hull and more particularly to a hull adapted for use with a small, easily transportable waterjet propelled watercraft.

Personal watercraft currently enjoy widespread popularity due to their ease of use and affordability. These watercraft typically employ an internal combustion engine coupled with a waterjet propulsion system oriented below the level of a seat for accommodating a rider as generally described in U.S. Pat. No. 5,584,733 to Kobayashi, incorporated herein by reference. Other personal watercraft are intended for use by a standing or kneeling rider. All of these watercraft are heavy in weight and require a trailer or other means for transporting the watercraft to the water, where the trailer and watercraft descend a boat ramp to enable the watercraft to access the water. In addition, the large size and heavy weight of these watercraft necessitate large amounts of horsepower to enable the watercraft to achieve the speed required to attain an optimum planing orientation and performance.

Planing-type hulls are well-known and commonly incorporated in the design of watercraft. The primary advantage provided by a planing-type hull over hulls of other design, such as displacement-type hulls found in canoes and kayaks and the like, is that a planing-type hull rises out of the water vertically as the horizontal speed of the watercraft increases, reducing the volume of the hull that is submerged thereby reducing drag and permitting higher speeds. The primary drawback of planing-type hulls, particularly with respect to many of the narrower hulls of the type found in contemporary personal watercraft, is the lack of stability when travelling in a straight line. This problem is exacerbated in rough waters. When such planing-type hulls are powered by means of water-jet propulsion, the tendency of the transom to rise with increasing speed combined with rough waters inevitably results in a loss of power and control as the jet pump intake loses contact with the water.

Watercraft of the prior art have sought by various methods and designs to solve the control problem inherent in jet-powered watercraft having planing-type hulls. U.S. Pat. No. 4,004,542 to Holmes, incorporated herein by reference, is directed to a boat for use with a waterjet propulsion unit incorporating a planing hull having a generally V-shaped bottom with a depending flat-bottomed support pod and stabilizing strakes. U.S. Pat. No. 3,911,846 to England, incorporated herein by reference, is directed to a shallow draft boat hull for use with a waterjet propulsion unit, said hull comprising an elongate step extending longitudinally of the bottom along the keel forwardly from the transom. These prior art arrangements sought to improve straight ahead stability but at the cost of speed due to the increased resistance with the water surface of the structures depending from the hull.

In addition, waterjet powered personal watercraft currently almost uniformly employ a two-stroke engine because of the high horsepower output provided by the two-stroke engine. However, two-stroke engines contribute high levels of pollution to waterways, especially when used in tandem with an exhaust system which injects exhaust directly into the water. The use of a four stroke engine minimizes water pollution compared to two-stroke engines used in the majority of watercraft. In conventional watercraft employing a two-stroke marine engine, between 25 and 35 percent of all of the gasoline in the tank is discharged through the tailpipe unburned and directly into the waterway because water is drawn into the engine for cooling and then mixed with exhaust and expelled. The design of the two-stroke engine allows unburned fuel to enter the cylinder at the same time the burned residue from the previous stroke is expelled from the engine. In addition, in a two-stroke engine lubricating motor oil mixes with gasoline, and as a result the expelled unburned gasoline contains heavier, non-evaporating motor oils. A four-stroke engine, on the other hand, has a dedicated combustion and exhaust stroke, substantially eliminating the problem of escaping unburned fuel. The use in the present invention of a four-stroke engine in combination with an exhaust system which expels exhaust into the air therefore represents an improvement over personal watercraft of the prior art.

Accordingly, it is a principal object of the present invention to provide an improved hull for a watercraft having stability while stationary and at low speed as well as stability and minimal water resistance when travelling at high speed straight ahead.

It is yet another object of the present invention to provide an improved hull which reduces the structural stress concentration within the hull and provides an efficient means for removal of water that otherwise would create secondary drag.

It is another object of the present invention to provide an improved hull for a watercraft which facilitates boarding of the watercraft from the water; particularly deep water.

It is another object of the present invention to provide a lightweight waterjet powered watercraft having an improved hull.

It is still another object of the present invention to provide a waterjet powered water craft with a removable power source so that the watercraft may be carried by a single person and transported without the need of a trailer.

It is yet another object of the present invention to provide an improved hull which minimizes weight bias balance problems.

It is still another object of the present invention to provide an improved exhaust system for a watercraft comprising the improved hull.

It is still another object of the present invention to provide an improved waterjet pump system for a watercraft comprising the improved hull.

It is a still further object of the present invention to provide an environmentally friendly power supply for a watercraft comprising the improved hull.

These and other objects of the invention will become clear from an inspection of the detailed description of the invention and from the appended Claims.

SUMMARY OF THE INVENTION

A novel planing boat hull has been developed which has an upper deck portion and a lower hull portion, a fore and an aft portion, a bow, a stern and a cockpit. The hull is configured having a bow tapering outwardly and increasing in width gradually to a point proximal to the rear of the cockpit at which point the width of the hull narrows and tapers inwardly. The inward taper of the hull flattens sternward so that opposing longitudinal sides of the aft portion of the hull are substantially parallel for a length, taper slightly and meet forming the stern. The lower hull portion comprises, in front elevational cross-section, a shallow V-shaped bottom face which extends substantially from the bow to the stern. The bottom face of the lower hull portion gradually curves upwardly toward the bow and further comprises a substantially T-shaped planing surface. The upper deck portion of the hull comprises a more gradual taper as the transition is made sternward from the fore portion of the hull to the aft portion than in the lower hull portion. The hull of the present invention provides optimum stability in the straight ahead direction while minimizing water resistance, thus enabling relatively high speeds with a minimum of horsepower. The hull further provides optimum stability when stationary in the water and when travelling at low speeds. The addition in a preferred embodiment of strakes to the fore portion of the hull provides increased stability with a minimum of drag at high speeds. The hull configuration also allows a rider to easily access the cockpit of the hull from the water because the narrower aft portion provides access to the cockpit closer to the center line of the hull than is possible in a hull having a traditional beam.

An opening is formed in the upper deck of the hull for receiving a power source into a compartment formed between the upper deck and lower hull. At least one watertight hatch covers said opening, said hatch further comprising at least one air intake port. The cockpit further comprises at least one seat for accommodating at least one rider. The hull further comprises at least one air exhaust port formed in the upper deck of the aft portion. In one embodiment the air exhaust port further comprises a cover which is movable between an open and closed position to prevent the entry of water into the engine compartment if the hull is capsized. In another embodiment the exhaust port is formed in said hatch. In another embodiment the hull further comprises a plurality of openings formed therein covered by watertight hatches for storage of valuables, safety gear and the like. In a preferred embodiment the invention further comprises a waterjet propulsion unit contained in said hull connected to the power source, steering means and a throttle means. The water jet propulsion unit further comprises a water intake duct, a pump assembly comprising a pump, a pump shaft and a shaft coupling device and a stern steering nozzle. In one embodiment the power source comprises a fuel source such as but not limited to a fuel tank or battery and an engine, an exhaust manifold, a drive shaft with or without a torque converter and a connector means for connecting the fuel source to the motor or engine. In the preferred embodiments, the engine is cooled by an air cooling system comprising an air intake duct coupled with an air intake port formed in the engine compartment hatch. Air is introduced to the engine compartment and circulated therein and expelled through a plurality of air exhaust ports. In yet another embodiment the fuel source is a battery and solar panels are disposed on or above the upper deck portion of the hull and the battery is connected to the solar panels to collect and store energy. In still another embodiment the power source is removably mountable in the engine compartment through said hatch. The waterjet propulsion unit may also be removably mounted to the hull. At least one handle means may be formed in the hull to facilitate transport of the hull. In still another preferred embodiment, the hull comprises two discrete, connectible units, the waterjet propulsion unit and at least one element of the power source being contained within the aft portion.

In a preferred embodiment the pump assembly comprises a specialized pump designed to operate at the limits of the power source. In another embodiment, the weight of the propulsion unit and power source is distributed to facilitate easy righting.

DETAILED DESCRIPTION OF THE PREFERRED EMBODIMENTS

Figure 1:
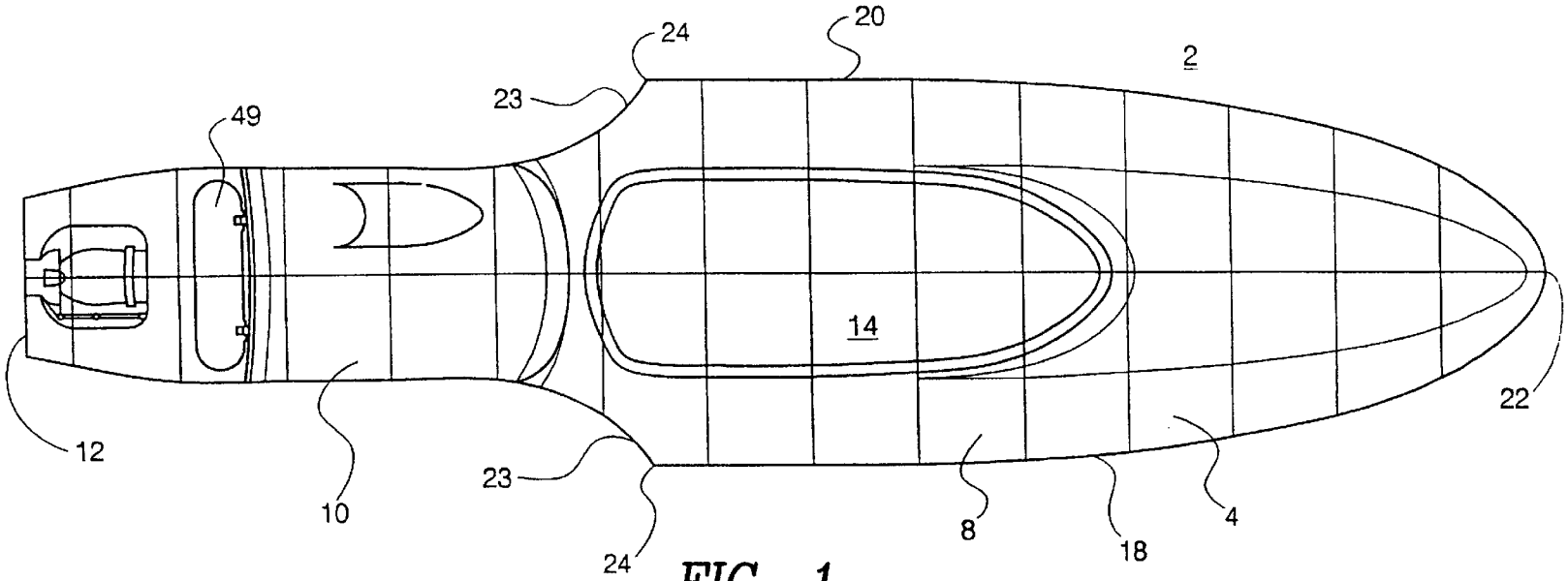
FIG. 1 is a top plan view of the hull according to this invention.
Figure 2:
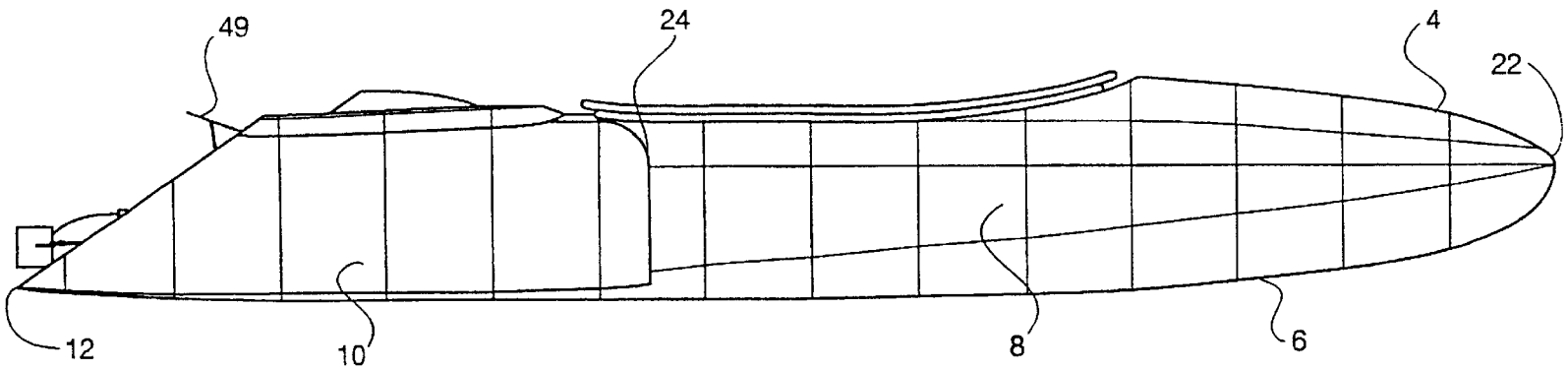
FIG. 2 is a side elevational view of the hull of FIG. 1.
Figure 4:
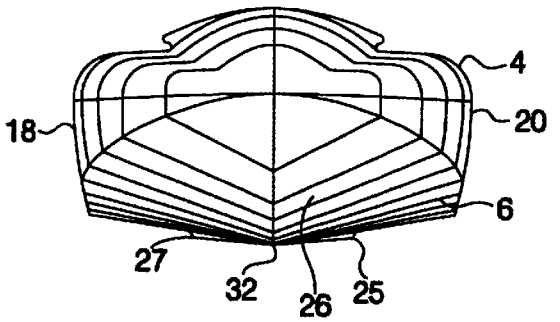
FIG. 4 is a front elevational view of the hull of FIG. 1.

Referring to FIGS. 1, 2 and 4 the invention comprises a planing hull 2 having essentially an upper deck portion 4 and a lower hull portion 6, said upper deck and lower hull portions 4 and 6 secured together by any suitable means. Hull 2 may comprise a unitary construction wherein said upper deck portion 4 and lower hull portion 6 are formed together in one piece. The hull 2 may be formed of any suitable material including but not limited to molded plastic, fiberglass, reinforced fiberglass, epoxy resin, polycarbonate, and the like. In a preferred embodiment the hull 2 is a monocoque or one piece hull formed of a high density polyethylene resin such as but not limited to superlinear polyethylene by an environmentally friendly rotomolding process.

The hull 2 further comprises a fore portion 8, an aft portion 10, a stern 12 and a cockpit 14. As best seen in FIG. 1, the fore portion 8 of the hull 2 comprises opposing longitudinal sides 18 and 20 meeting at a bow 22, said bow 22 tapering outwardly, increasing in width gradually to a point 24 proximal to the rear of the cockpit 14, at which point 24 the width of the hull 2 narrows and tapers inwardly. Fore portion 8 may comprise a bulkhead aft of cockpit 14 forming a closure of the fore portion 8 of the hull 2. The point 24 at which the hull 2 begins to narrow substantially defines the start of the transition 23 between the end of the fore portion 8 and the beginning of the aft portion 10. The inward taper of the hull 2 flattens sternward so that the opposing longitudinal sides 18 and 20 of the aft portion 10 of the hull 2 are substantially parallel for a length and meet forming the stern 12. The maximum width of the aft portion 10 of the hull 2 is in the range of approximately ⅕ to approximately ⅘ of the width of the fore portion 8. In a preferred embodiment the width of the aft portion 10 is approximately ½ the width of the fore portion 8 at the widest portion on the fore portion 8.

Figure 3:
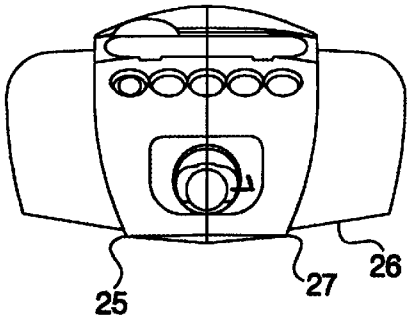
FIG. 3 is a rear elevational view of the hull of FIG. 1.
Figure 5:
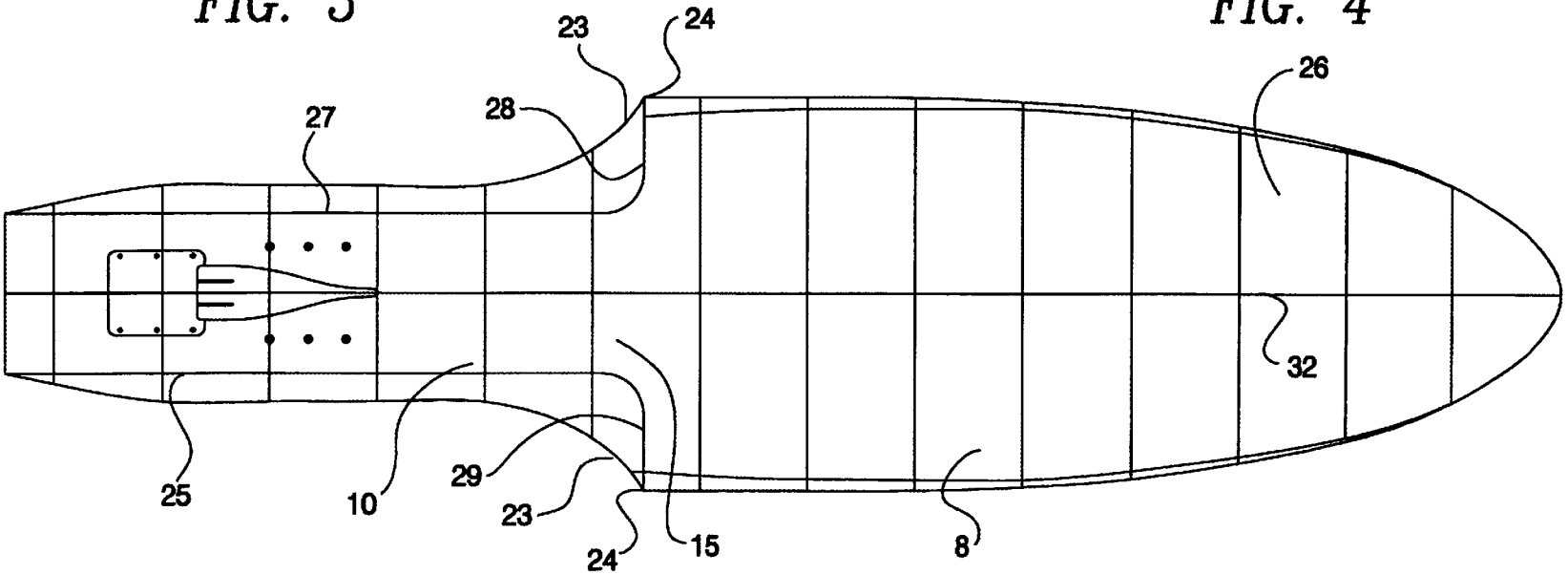
FIG. 5 is a bottom plan view of the hull of FIG. 1.

Now referring to FIGS. 3 and 4, the lower hull portion 6 comprises in cross section a shallow V-shaped bottom face 26, a centerline 32 forming the bottom of said V, said shallow V-shape extending substantially from the bow 22 to the stern 12. The bottom face 26 of the lower hull portion 6 extends outwardly from either side of the centerline 32 forming a V-shaped bottom face 26. Referring next to FIG. 2, the bottom face 26 of the lower hull portion 6 of the fore portion 8 gradually curves upwardly toward the bow 22. Now referring to FIGS. 3, 4 and 5, the bottom face 26 of the lower hull portion 6 further comprises a substantially T-shaped planing surface 15 comprising the bottom face of narrow aft portion 10 joined to the bottom face of wider fore portion 8 of the hull 2 and edges 25, 27, 28 and 29. The upper deck portion 4 of the hull 2 comprises a more gradual taper as the transition 23 is made sternward from the fore portion 8 of the hull 2 to the aft portion 10 than in the lower hull portion 6. This construction reduces the stress concentration of the transition 23 and provides an efficient means for water management, i.e., removal of water that otherwise would create secondary drag.

In a preferred embodiment the hull 2 is approximately twelve feet in length and approximately three feet in diameter at the widest portion of the fore portion 8. The width of the aft portion 10 in the preferred embodiment is in the range of approximately seventeen to twenty four inches.

Figure 5A:
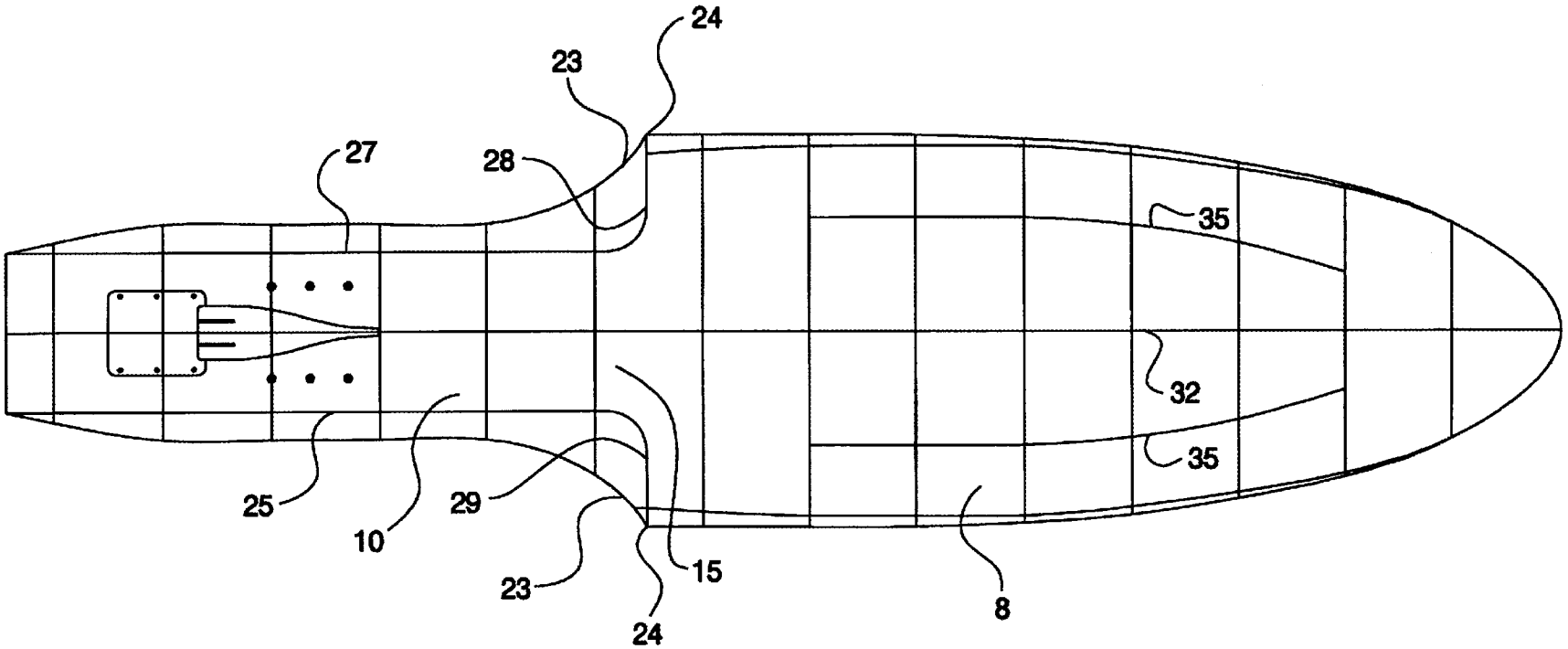
FIG. 5*a* is a bottom plan view of a preferred embodiment of the hull of FIG. 1.

Now referring to FIG. 5*a*, in another preferred embodiment the fore portion 8 of the hull 2 is equipped with at least one pair of strakes 35 along either side of the center line 32.

It has been discovered that the hull configuration of the present invention provides surprisingly good stability in the straight ahead direction while minimizing the amount of water resistance encountered, providing an efficient means for travelling at relatively high speeds with a minimum of horsepower. As speed increases, the fore portion 8 of the hull 2 rises above the surface of the water, leaving substantially only the bottom face of the aft portion 10 and a minimal surface area of the fore portion 8 in contact with the water. The reduced surface area in contact with the water results in a minimization of drag and therefore an optimization of horsepower. The addition of strakes in the preferred embodiment add lateral stability without sacrificing efficiency at high speeds because the strakes are above the water line at elevated speeds.

The hull configuration also allows a rider to easily access the cockpit 14 of the hull 2 from the water because the narrower aft portion 10 provides access to the cockpit 14 closer to the center line 32 of the hull 2 than would be possible in a hull having a wider beam. Thus, the hull 2 is less apt to tip toward the boarding rider.

Tests were conducted using the hull 2 of the present invention to evaluate the efficiencies of the hull configuration. Tables 1 lists the results:

TABLE 1

| Run | Speed (mph) | Trim (deg) | Draft (ft) | Drag (lb) | Estimated HP (EHP) | Shaft HP (SHP) |
|---|---|---|---|---|---|---|
| Configuration B3: 2 passengers, driver aft, with strakes | | | | | | |
| 134 | 0.00 | −1.88 | 0.488 | 0.00 | 0.00 | 0.00 |
| 135 | 15.05 | 3.90 | 0.190 | 73.79 | 2.96 | 4.47 |
| 136 | 24.98 | 1.93 | 0.083 | 79.88 | 5.32 | 8.04 |
| Configuration B1, driver only, aft, with strakes | | | | | | |
| 137 | 0.00 | −0.63 | 0.393 | 0.00 | 0.00 | 0.00 |
| 138 | 15.04 | 3.67 | 0.078 | 50.35 | 2.02 | 3.05 |
| 139 | 24.95 | 2.79 | 0.028 | 62.27 | 4.14 | 6.26 |

TABLE 1-continued

| Run | Speed (mph) | Trim (deg) | Draft (ft) | Drag (lb) | Estimated HP (EHP) | Shaft HP (SHP) |
|---|---|---|---|---|---|---|
| Configuration C3, 2 passengers, driver aft, no strakes | | | | | | |
| 140 | 0.00 | −1.95 | 0.475 | 0.00 | 0.00 | 0.00 |
| 141 | 15.04 | 3.55 | 0.200 | 68.94 | 2.77 | 4.18 |
| 142 | 24.95 | 1.91 | 0.088 | 79.63 | 5.31 | 8.01 |
| Configuration C1, driver only, aft, no strakes | | | | | | |
| 143 | 0.00 | −0.71 | 0.387 | 0.00 | 0.00 | 0.00 |
| 144 | 15.09 | 3.49 | 0.087 | 48.12 | 1.94 | 2.93 |
| 145 | 25.08 | 2.78 | 0.035 | 60.79 | 4.07 | 6.14 |

Figure 6:
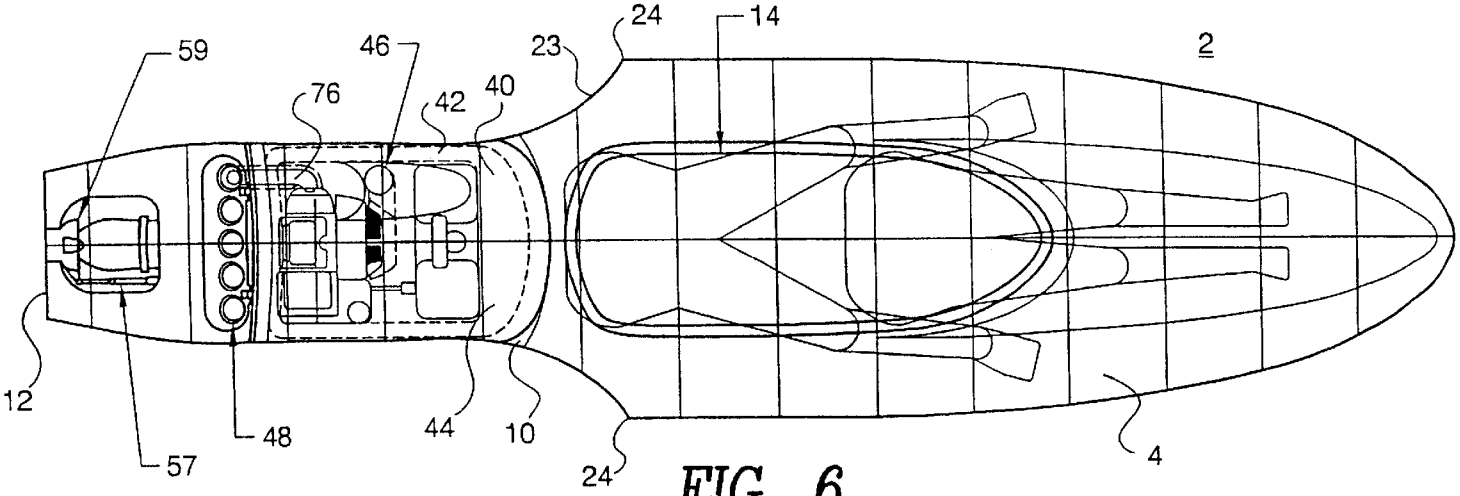
FIG. 6 is a top plan view of a watercraft according to a preferred embodiment of the invention.
Figure 7:
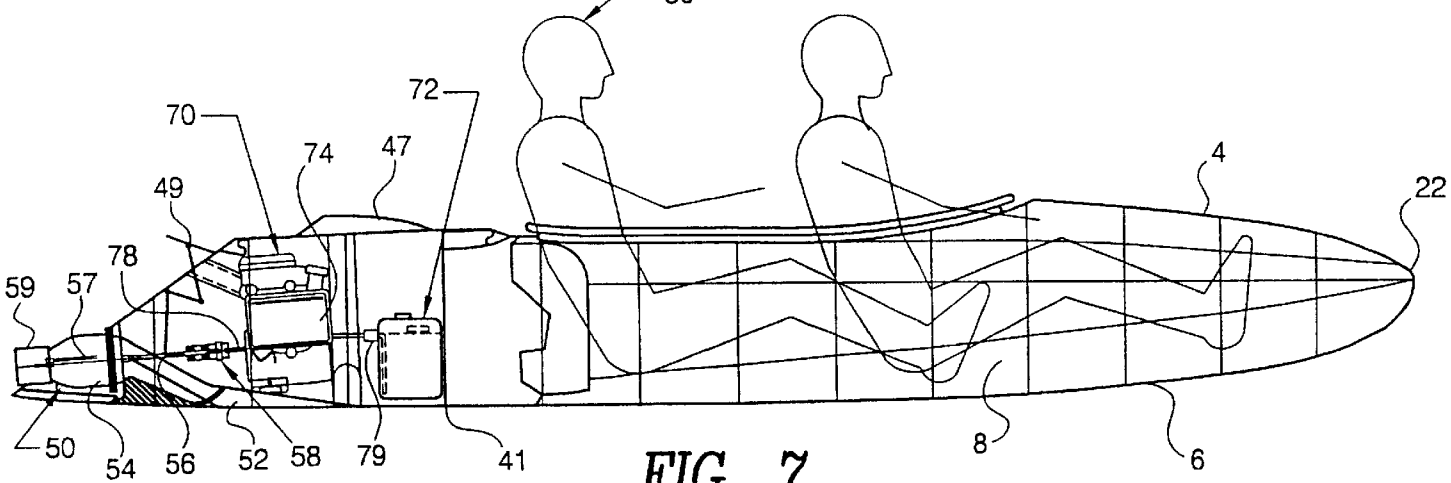
FIG. 7 is a side elevational view of the watercraft of FIG. 6.

Now referring to FIGS. 6 and 7, in another preferred embodiment a watercraft constructed in accordance with the hull 2 of the present invention comprises hull 2, a cockpit 14 formed in the upper deck 4 of hull 2, an opening 40 formed in the upper deck 4 of the aft portion 10 for receiving a power source such as but not limited to an engine and a fuel tank into a compartment 42 formed between the upper deck 4 and lower hull 6 and at least one watertight hatch 44 for covering said opening 42. Said hatch further comprises an air intake port 46. The cockpit 14 further comprises at least one seat (not shown) for accommodating at least one rider 80. The hull 2 further comprises at least one air exhaust port 48 formed in the upper deck 4 of the aft portion 10. In one embodiment the air exhaust port 48 further comprises a cover 49 which is movable between an open and closed position to prevent the entry of water into the compartment 42 if the hull 2 is capsized. In another embodiment the exhaust port 48 comprises an opening in the hatch 44. The hull 2 may further comprise a plurality of openings formed therein covered by watertight hatches for storage of valuables, safety gear and the like. The hull may further comprise a bulkhead 41 forming a barrier between the cockpit 14 and compartment 42. Bulkhead 41 is preferably fireproof.

The watercraft according to the preferred embodiment of FIGS. 6 and 7 further comprises a waterjet propulsion unit 50, a power source 70, steering means (not shown) and a throttle means (not shown).

As best seen in FIG. 7, water jet propulsion unit 50 further comprises a water intake duct 52, a pump assembly comprising a pump 54, a pump shaft 56 and a shaft coupling device 58, and a stern steering nozzle 59 of known design such as that described in U.S. Pat. No. 4,047,494, incorporated herein by reference.

As best seen in FIGS. 6 and 7, power source 70 further comprises a fuel source 72, such as but not limited to a fuel tank or battery, an engine 74 such as but not limited to a Honda four stroke engine or a combustion engine of any number of cycles or an electric-motor, an ignition means (not shown), an exhaust manifold 76, a drive shaft 78 with or without a torque converter, and a connector means 79 for connecting the fuel source to the motor or engine, such as a fuel line where the engine is a combustion engine or an electrical cable wherein the motor is electric. The engine 74 may be water-cooled; however, in the preferred embodiments, the engine 74 is cooled by an air cooling system comprising air intake duct 47 coupled with air intake port 46 formed in the hatch 44. Air is introduced to the engine 74 for cooling and expelled through at least one air exhaust port 48 to facilitate air exchange. In this preferred embodiment the exhaust manifold 76 communicates with at least one of air exhaust ports 48 so that exhaust is expelled into the air rather than into the water as is customary with most watercraft. In this manner the environmental impact on aquatic and marine systems is minimized.

The combination of the design of hull 2 and the weight and location of the propulsion unit 50 and power source 70 results in a highly balanced watercraft which resists tipping and if the watercraft of the present invention rolls, the watercraft is easily righted.

In yet another embodiment the fuel source is a battery (not shown) located in the compartment 42 and solar panels (not shown) are disposed on or above the upper deck portion 4 of the hull 2 of the watercraft and the battery is connected to the solar panels to collect and store energy.

A cable 57 connects steering nozzle 59 to a steering means (not shown) such as but not limited to a wheel or stick to enable an operator to steer the watercraft.

Throttle means (not shown) may comprise any throttle means commonly found in pleasure craft such as but not limited to a throttle cable connecting the power source 70 to a stick, handlebar throttle or pedal means.

A flexibility closure such as a spray skirt for keeping the cockpit 14 watertight is not shown. At least one handle means (not shown) may be formed in the hull 2 to facilitate transport of the hull 2. Furthermore, it is contemplated that cockpit 14 may be modified to accommodate more than one person. The driver 80 of the watercraft of the preferred embodiment may be seated fore or aft in the cockpit, either behind or in front of a passenger.

Now referring to FIGS. 6 and 7, power source 70 turns drive shaft 78 through coupling 58 which in turn transfers rotational power to the waterjet propulsion unit 50 via the pump shaft 56. The coupling 58 can be direct drive or can incorporate a torque converter. The pump assembly receives water via water intake duct 52 and accelerates the water and communicates it through pump 54. Water is ejected to the stern steering nozzle 59.

In another embodiment the power source 70 and/or the waterjet propulsion unit 50 are removably mountable in the compartment 42. Access to said removably mounted power source 70 and/or waterjet propulsion unit is through hatch 44. Power source mounting means (not shown) may be of any type such as but not limited to clamping means whereby the power source and/or fuel source are clamped to load dispersing rails, slidable engagement means such as tongue and groove-type assemblies, mounting means disclosed in U.S. patent application Ser. No. 08/861,845, incorporated herein by reference, and the like. Waterjet propulsion unit 50 comprising pump 54, a pump shaft 56 and shaft coupling device 58 may be removably mounted to the hull 2 by similar means to sealingly engage said water intake duct 52. Coupling 58 may be disengaged to disconnect power source 70 from waterjet propulsion unit 50.

Figure 8:
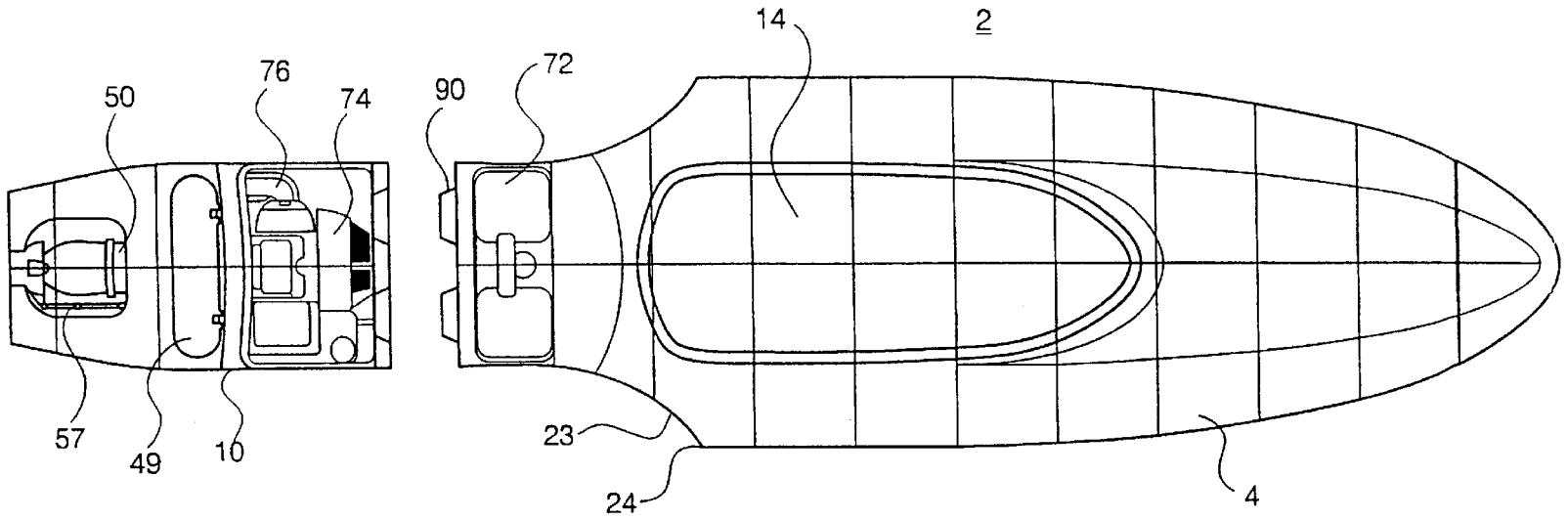
FIG. 8 is a top plan view of a preferred embodiment of the invention.
Figure 8A:
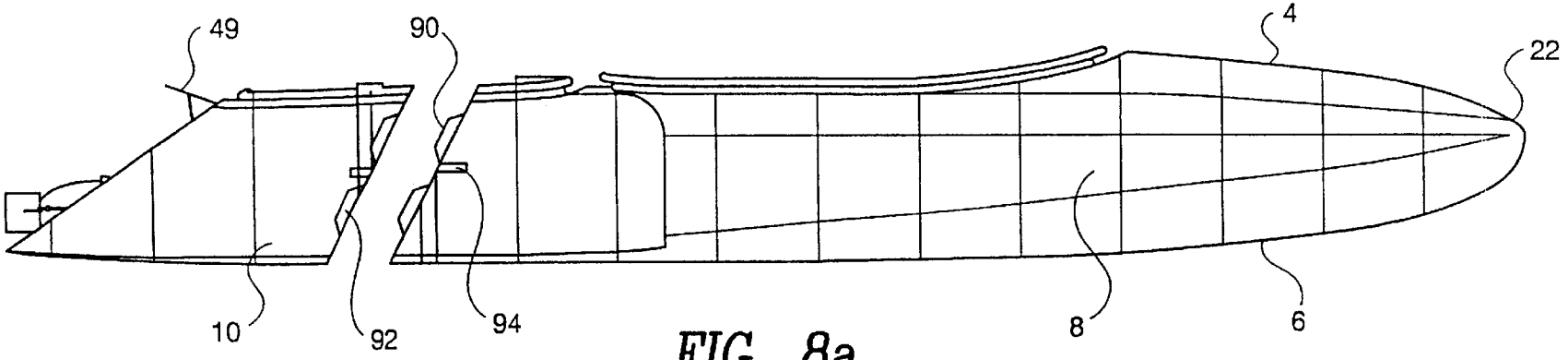
FIG. 8*a* is a side elevational view of the preferred embodiment of FIG. 8.

Now turning to FIGS. 8 and 8*a*, in still another preferred embodiment, hull 2 comprises two discrete, connectible units substantially comprising the fore portion 8 and the aft portion 10 to facilitate transport of the watercraft out of the water. In a most preferred embodiment, the waterjet propulsion unit 50 and engine 74 are contained within the aft portion 10. The fore portion 8 contains fuel source 72. Alternatively, the entire power source may be contained in either the fore portion 8 or the aft portion 10. The fore portion 8 and aft portion 10 further comprise complementary connectible mating means of known design for connecting said fore and aft portions 8 and 10. In the most preferred embodiment the mating means comprises at least one male register 90 and at least one female register 92. Male register 90 is received in female register 92 to ensure secure alignment of said fore and aft portions 8 and 10 and at least one over-center clamp 94 or other suitable clamping means secures said fore and aft portions 8 and 10. A handle means (not shown) for facilitating carrying of the discrete fore and aft portions 8 and 10 of the hull 2 are formed in each of the respective portions 8 and 10.

Figure 9:
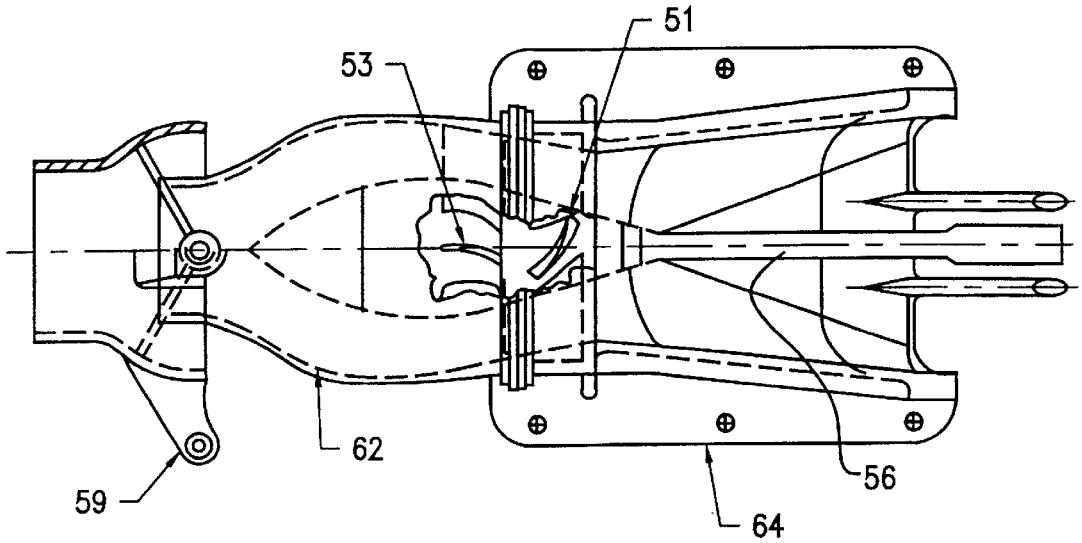
FIG. 9 is a top sectional view of one embodiment of the pump according to a preferred embodiment of the present invention.
Figure 10:
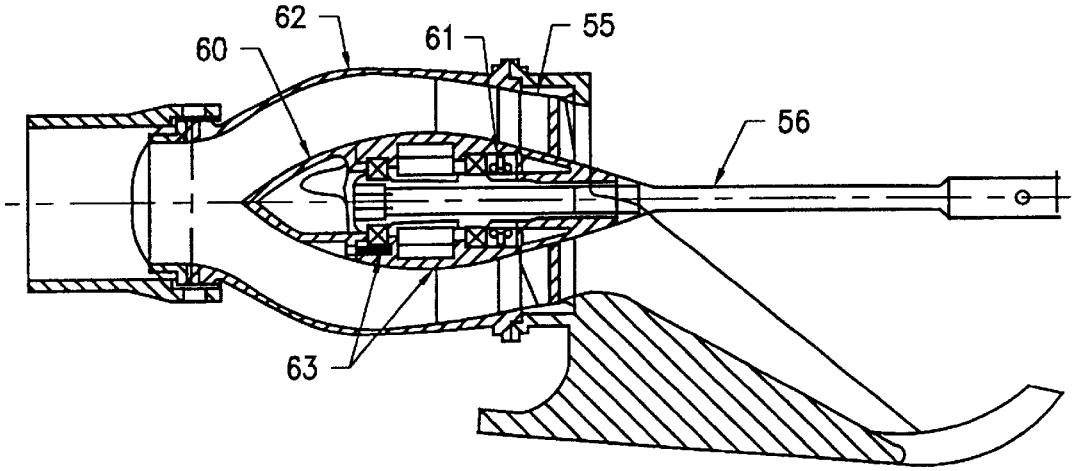
FIG. 10 is a side sectional view of one embodiment of the pump according to FIG. 9.

In a preferred embodiment the pump assembly comprises a specialized pump designed to operate at the limits of the power source. In a most preferred embodiment the power source 70 is a Honda air-cooled four-stroke overhead cam single cylinder engine such as the GC 160 (horizontal shaft) engine comprising a displacement of 160 cc and a compression ratio of 8.5:1, having a maximum power output of 5.0 horsepower/3,600 rpm and 7.6 ft.-lbs of torque and is coupled with said specialized pump. Now referring to FIGS. 9 and 10, the pump 54 employs an axial flow pump system comprising a plurality of rotor vanes 51, a venturi/stator vane 53, and at least one rotor 55 having a diameter in the range of about 3 inches and about 5 inches and preferably approximately 3.91 inches and a jet diameter in the range of about 1.5 inches and about 3.5 inches and preferably approximately 2.43 inches. Pump 54 further comprises a hub cone 60, a plurality of seals 61, venturi/stator 62, a plurality of bearings 63 and housing 64. This most preferred embodiment resulted in a flow of 749 gallons per minute, 49.3 pounds of thrust, a jet velocity of 52.0 feet/second and a pump efficiency 80 percent. In this embodiment the water inlet 52 comprises a scoop formed in the bottom of hull 2.

While the invention has been described in connection with what is presently considered to be the most practical and preferred embodiments, it is understood that the invention is not to be limited to the disclosed embodiment, but on the contrary, is intended to cover various modifications and equivalent arrangements included within the spirit and scope of the appended claims.

What is claimed is:

1. A planing hull comprising a fore portion, an aft portion, an upper deck portion and a lower hull portion, said lower hull portion further comprising a wetted planing surface, said wetted planing surface generally T-shaped in plan, a fore portion comprising a bow tapering outwardly toward a midportion, an aft portion extending to said midportion, said planing surface of said lower hull portion gradually curving upwardly toward said bow and further comprising a centerline, said planing surface of said lower hull portion extending outwardly from opposite sides of said centerline forming a bottom face generally V-shaped in cross-section.

2. The planing hull according to claim 1 further comprising at least one cockpit formed in said upper deck portion.

3. The planing hull according to claim 2 further comprising at least one compartment formed within said upper deck and said lower hull portion.

4. The planing hull according to claim 3 wherein said compartment further comprises an opening in said upper deck for receiving a power source, and wherein said hull further comprises at least one watertight hatch for sealing said opening.

5. The planing hull according to claim 4 wherein said compartment further comprises a power source mounted therein.

6. The planing hull according to claim 5 wherein said power source is removably mounted.

7. The planing hull according to claim 6 wherein said power source is a motor linked to a fuel source.

8. The planing hull according to claim 7 further comprising a means for accelerating water sternward and an intake means communicating with a body of water on which the hull is located for providing water to the means for accelerating water.

9. The planing hull according to claim 8 further comprising a means for connecting said power source to said means for accelerating water sternward and a means for steering said planing hull.

10. The planing hull according to claim 9 wherein said means for accelerating water sternward is contained within said compartment.

11. The planing hull according to claim 10 wherein said means for accelerating water sternward is removably mounted within said compartment.

12. The planing hull according to claim 11 wherein the fuel source is a tank for containing combustible fuel and the motor is an internal combustion engine.

13. The planing hull according to claim 11 wherein the fuel source is a battery and the motor is an electric motor.

14. The planing hull according to claim 8 wherein the means for accelerating water sternward is a water jet propulsion unit.

15. The planing hull according to claim 8 wherein the power source and the means for accelerating water sternward are disposed such that the watercraft is self-righting.

16. The planing hull according to claim 12 wherein said motor is a four-stroke engine.

17. The planing hull according to claim 1 further comprising at least one pair of strakes formed on said planing surface of said hull.

18. The planing hull according to claim 9 further comprising at least one pair of strakes formed on said planing surface of said hull.

19. The planing hull according to claim 1 wherein said hull comprises two discrete, connectible units comprising said fore portion and said aft portion, said fore portion and said aft portion further comprising complementary connectible mating means for connecting said fore and aft portions to form said hull.

20. The planing hull according to claim 1 further comprising a power source mounted thereon.

21. The planing hull according to claim 20 wherein said power source is removably mounted.

22. The planing hull according to claim 1 further comprising a power source and a means for accelerating water sternward.

23. The planing hull according to claim 22 further comprising an intake means for communicating with a body of water on which the hull is located for providing water to the means for accelerating water.

24. A planing hull according to claim 23 wherein said jet propulsion unit further comprises an axial flow pump comprising a plurality of rotor vanes, at least one stator vane and at least one rotor having a diameter of between about 3 inches and about 5 inches and a jet diameter of between about 1.5 inches and about 3.5 inches.

25. A planing hull according to claim 24 wherein said rotor has a diameter of about 3.91 inches and said pump jet has a diameter of approximately 2.43 inches.

26. A planing hull according to claim 1 wherein said hull is formed of a material selected from the group consisting of plastic, fiberglass, reinforced fiberglass, epoxy resin, and polycarbonate.

27. A planing hull according to claim 1 wherein said hull is monocoque.

28. A planing hull according to claim 27 wherein said hull is formed of polyethylene by rotomolding.

29. A planing hull according to claim 14 wherein said jet propulsion unit further comprises an axial flow pump comprising a plurality of rotor vanes, at least one stator vane and at least one rotor having a diameter of between about 3 inches and about 5 inches and a jet diameter of between about 1.5 inches and about 3.5 inches.

30. A planing hull according to claim 29 wherein said rotor has a diameter of about 3.91 inches and said pump jet has a diameter of approximately 2.43 inches.

31. A planing hull comprising a fore portion, an aft portion, an upper deck portion and a wetted planing surface, said wetted planing surface generally T-shaped in plan, substantially comprising a lower hull portion of said fore portion and said aft portion, said fore portion comprising a bow tapering outwardly toward a midpoint, said aft portion extending to said midpoint, said planing surface of said lower hull portion of said fore portion gradually curving upwardly toward said bow and further comprising a centerline formed in said planing surface, said planing surface of said lower hull portion extending outwardly from opposite sides of said centerline forming a generally V-shaped in plan bottom face, at least one cockpit formed in said upper deck portion, at least one compartment formed within said upper deck and said lower hull portion, said compartment further comprising an opening in said upper deck for receiving a power source, said hull further comprising at least one watertight hatch for sealing said opening, and a power source mounted in said compartment; and a means for accelerating water disposed within said hull and an intake means communicating with a body of water on which the hull is located for providing water to the means for accelerating water, a means for connecting said power source to said means for accelerating water and a means for steering said planing hull.

32. The planing hull according to claim 31 wherein said power source is removably mounted.

33. The planing hull according to claim 32 wherein said means for accelerating water sternward is contained within said compartment.

34. The planing hull according to claim 33 wherein said means for accelerating water sternward is removably mounted within said compartment.

35. The planing hull according to claim 34 wherein the means for accelerating water sternward is a water jet propulsion unit.

36. The planing hull according to claim 35 wherein the power source is a tank for containing combustible fuel and the motor is an internal combustion engine.

37. The planing hull according to claim 36 wherein said motor is a four-stroke engine.

38. The planing hull according to claim 35 wherein the fuel source is a battery and the motor is an electric motor.

39. The planing hull according to claim 31 wherein the power source and the means for accelerating water sternward are disposed such that the watercraft is self-righting.

40. The planing hull according to claim 31 further comprising at least one pair of strakes formed on said bottom face of said hull.

41. The planing hull according to claim 31 wherein said hull comprises two discrete, connectible units comprising said fore portion and said aft portion, said aft portion further comprising said means for accelerating water sternward and said power source, said fore portion and said aft portion further comprising complementary connectible mating means for connecting said fore and aft portions to form said hull, and further comprising handle means formed in each of the fore portion and aft portion.

42. A planing hull according to claim 31 wherein said jet propulsion unit further comprises an axial flow pump comprising a plurality of rotor vanes, at least one stator vane and at least one rotor having a diameter of between about 3 inches and about 5 inches and a jet diameter of between about 1.5 inches and about 3.5 inches.

43. A planing hull according to claim 42 wherein said rotor has a diameter of about 3.91 inches and said pump jet has a diameter of approximately 2.43 inches.

44. A watercraft comprised of a fore portion comprising a bow having a longitudinal centerline and opposing longitudinal sides that extend from the watercraft bow symmetrically around said centerline to a point of maximum width;

an aft portion having a width about one-fifth to about three-fifths the width of the point of maximum width of the fore portion; and a transition section between said fore and aft portions, said watercraft further comprising a lower hull formed continuously through the fore and aft portions, said lower hull further comprising a wetted planing surface that is generally T-shaped in plan, said T-shape generally formed of the lower hull portion of the aft portion and the lower hull portion at the point of maximum width of the fore portion, said lower hull portion further comprising a bottom face generally V-shaped in cross section, and further comprising a cockpit in the fore portion and propulsion means in the aft portion.

45. A watercraft as in claim 44 wherein the width of the aft portion is about one-half the width of the maximum width of the fore portion.

* * * * *